US006434967B2

(12) United States Patent
Emerick, Sr. et al.

(10) Patent No.: US 6,434,967 B2
(45) Date of Patent: Aug. 20, 2002

(54) PROCESS FOR FORMING COPPER CONTAINING COMPONENTS PROVIDING WATER EFFLUENT WITH LOWERED COPPER CONCENTRATIONS

(75) Inventors: Richard John Emerick, Sr.; Joel Ernst Leiser, both of Freeport; Michael John Howerter, Lanark; Jan Michael Pottinger, Lanark; Rick W. Brockhouse, Lanark; Stephen E. Gatz, Morrison; James Donald Worden, Savanna, all of IL (US)

(73) Assignee: Elkay Manufacturing Company, Oakbrook, IL (US)

( * ) Notice: Subject to any disclaimer, the term of this patent is extended or adjusted under 35 U.S.C. 154(b) by 0 days.

(21) Appl. No.: 09/918,661

(22) Filed: Jul. 31, 2001

Related U.S. Application Data

(62) Division of application No. 09/336,235, filed on Jun. 18, 1999.

(51) Int. Cl.[7] ..... F25D 17/02; B67D 5/62

(52) U.S. Cl. ..... 62/399; 62/99

(58) Field of Search ..... 62/389, 399, 99; 222/146.6; 239/29.3; 165/48.1, 163, 169

(56) References Cited

U.S. PATENT DOCUMENTS

| | | | | |
|---|---|---|---|---|
| 1,907,641 A | * | 5/1933 | Askin | |
| 1,918,131 A | * | 7/1933 | Ranstead | |
| 2,359,791 A | * | 10/1944 | Ralston | 62/141 |
| 3,739,842 A | * | 6/1973 | Whalen | 165/164 |
| 3,824,801 A | * | 7/1974 | Laudato, Jr. | 62/201 |
| 4,061,184 A | | 12/1977 | Radcliffe | |
| 4,351,678 A | | 9/1982 | Yves Andrien et al. | |
| 4,373,970 A | | 2/1983 | Scorey et al. | |
| 4,832,756 A | | 5/1989 | Woodward et al. | |
| 5,279,702 A | | 1/1994 | Douglas | |
| 5,667,103 A | | 9/1997 | Donselman et al. | |

FOREIGN PATENT DOCUMENTS

| | | |
|---|---|---|
| EP | 0356732 | 5/1992 |
| EP | 0647723 A1 | 9/1994 |
| JP | 09178325 A * | 7/1997 |

OTHER PUBLICATIONS

Cerrospec—Precision Thin–Wall Industrial Copper Tube.
Book Offers Case Studies in Corrosion Control.

* cited by examiner

*Primary Examiner*—Denise L. Esquivel
*Assistant Examiner*—Melvin Jones
(74) *Attorney, Agent, or Firm*—Niro Scavone Haller & Niro

(57) ABSTRACT

A process for annealing copper or copper-containing components, such as copper tubing, and/or for selecting copper with an appropriate grain size, such that potable water in contact with the properly treated and/or selected copper, has substantially decreased copper emissions, and may comply with ANSI/NSF 61. In one preferred embodiment, an ANSI/NSF 61-compliant water cooler may be constructed using a storage tank with wrapped copper water tubing treated and/or selected in this manner. The storage tank is preferably designed from non-copper components.

8 Claims, 4 Drawing Sheets

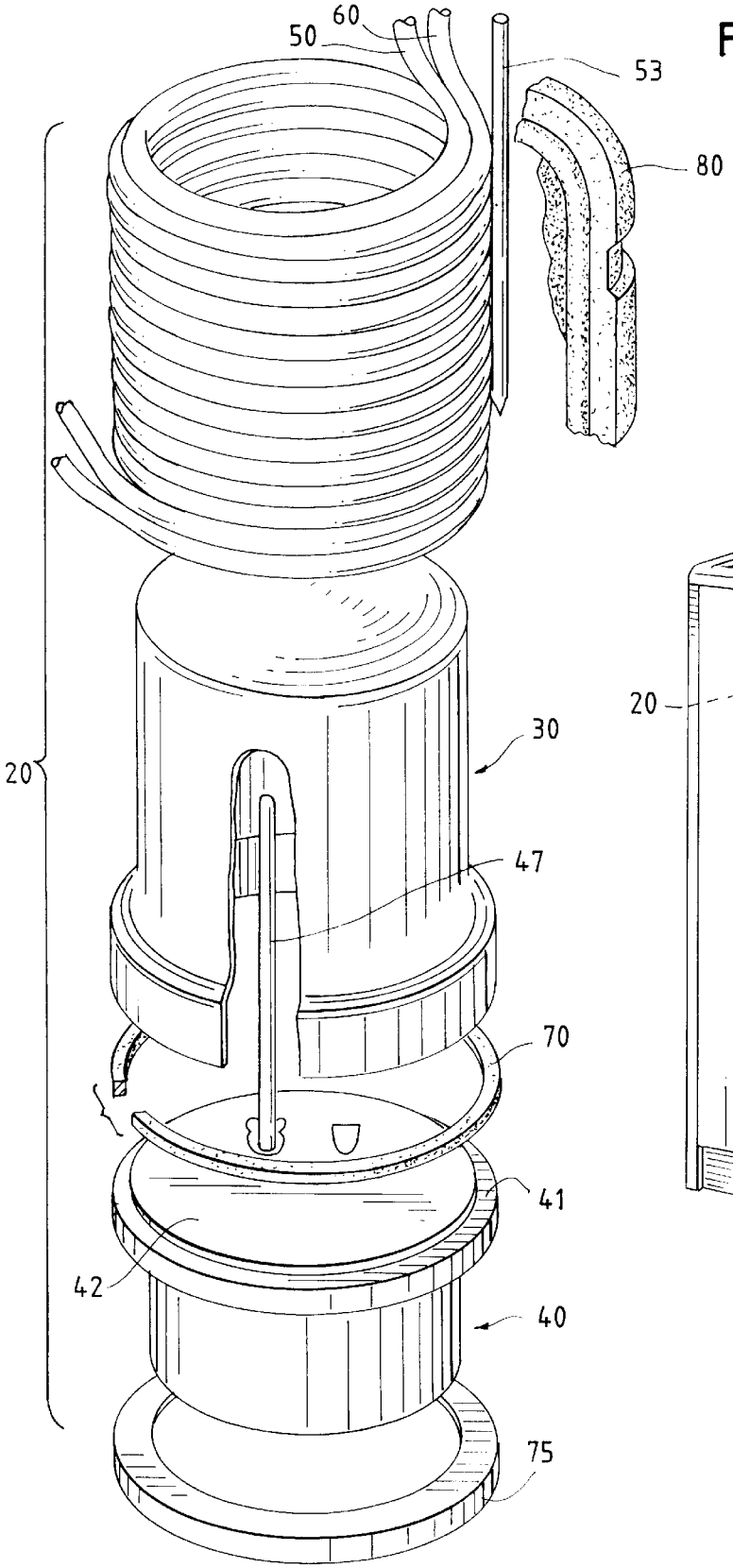
FIG. 1
FIG. 2
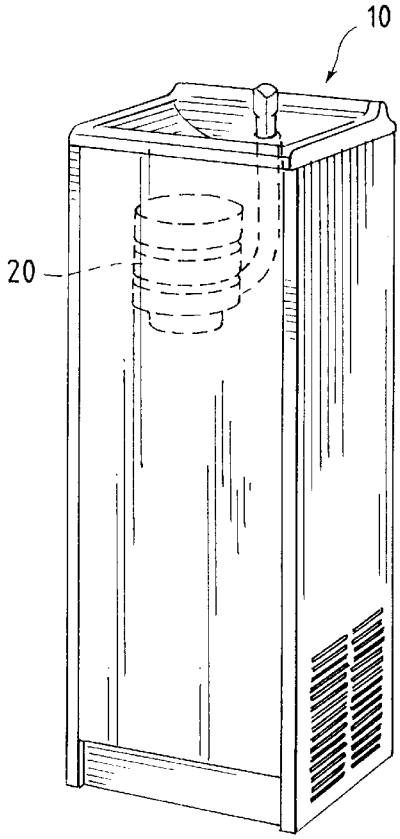

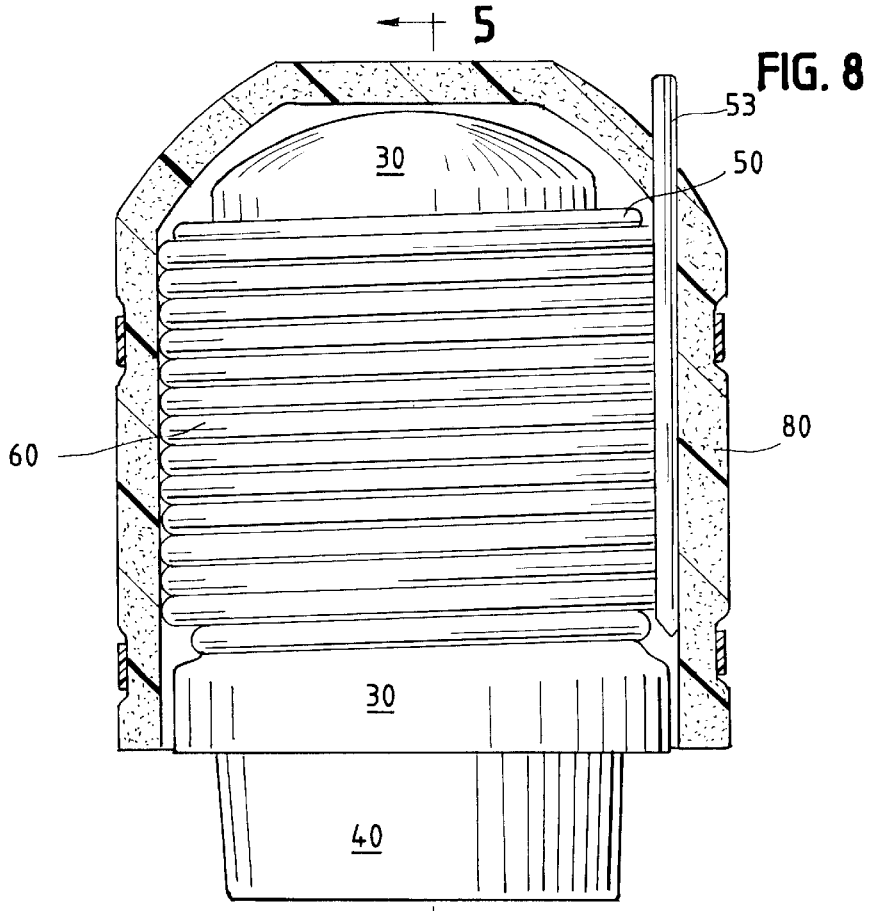
FIG. 8
FIG. 9 PRIOR ART
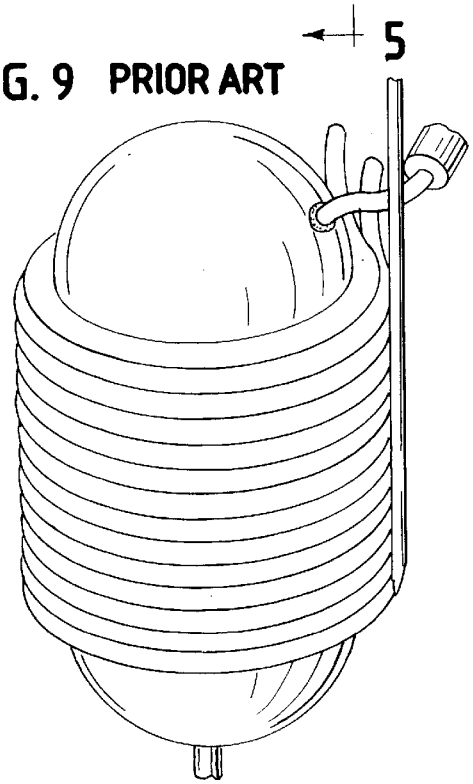
FIG. 10 PRIOR ART
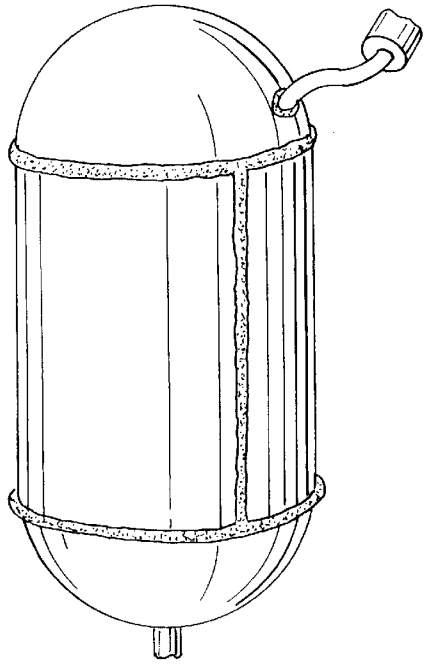

PROCESS FOR FORMING COPPER CONTAINING COMPONENTS PROVIDING WATER EFFLUENT WITH LOWERED COPPER CONCENTRATIONS

This application is a division of U.S. Ser. No. 09/336,235 filed Jun. 18, 1999.

BACKGROUND OF THE INVENTION

The present invention relates to a water cooler. More specifically, the present invention relates to a water chilling and storage apparatus for use in a water cooler which provides low copper concentrations in the water and other benefits.

Water supplied by water coolers, whether pressure coolers or bottle coolers, is receiving increasingly stricter scrutiny for public health and safety. In particular, the maximum allowable presence of certain metals, such as copper, in potable water has been lowered by public and private regulatory and governmental bodies such as the EPA and the National Sanitation Foundation (NSF), as further discussed below.

Water coolers may be generally divided into two types: pressure coolers and bottle coolers. Pressure coolers rely upon municipal pipe-supplied water under pressure (e.g., 45–90 psi), whereas bottle coolers rely upon gravity-fed water supplied from a bottle. Both types of water coolers typically employ a storage tank for holding chilled water of some predetermined volume (e.g., 0.2–0.5 gallons or more). When chilled water is required, it is thus immediately available.

With conventional water pressure coolers, water flows from a pressurized source through copper tubing typically wrapped around the outside of, and in heat exchange relation with, the water cooler storage tank. Alternatively, the water tubing may be wrapped around the inside surface of the storage tank, provided the diameter of the wrapped coil is carefully controlled so that after the coil is placed inside the tank, the coil is in sufficient heat-exchange contact with the inner wall of the storage vessel. With either design, the water within the copper tubing is first cooled by a refrigerant, such as freon. The refrigerant tubing may be wrapped around the outside of the storage tank, and beneath the copper (water) tubing, as shown in FIG. 9. Cooling of the water continues within the storage tank due to the adjacent refrigerant tubing.

Some copper storage tanks have been manufactured in a manner that requires the use of substantial seam weld lengths. One common example is shown in FIG. 10, which illustrates a three-part tank with two semi-spherical dome-like portions welded to a cylindrical portion. Each seam line shown in FIG. 10 is a potential source of leakage, and is also susceptible to corrosion due to the presence of degraded material in the weld seam. Brazed holes are typically provided in copper storage tanks to accept the copper tubing carrying the water. The brazed areas around these tubing openings in the tank are also potential sources of leakage and corrosion.

Water cooler storage tanks of the design shown in FIG. 10 have also been available in stainless steel. Spun copper tanks, as shown in FIG. 9, have also been available, eliminating weld seams but still requiring brazed water and refrigerant conduit holes.

Also, certain low capacity storage tanks have been made of seam-welded stainless steel and have not employed wrapped copper water tubing at all.

In addition to the problems referenced above with the use of an all-metal storage tank for water coolers, the emission of copper into potable water supplies is also regulated. To increase heat transfer efficiency, water cooler storage tanks have generally been made of copper. Copper is an excellent conductor of heat, easy to work and form, and relatively simple to solder or braze. The use of copper in plumbing systems for the supply of potable water is widespread.

ANSI (American National Standard Institute)/NSF 61 is currently a voluntary standard that regulates the presence of certain contaminants in drinking water systems. ANSI/NSF 61 ("NSF 61") covers all materials that come in contact with potable water supplies. The majority of components used in the construction of water coolers are in compliance with NSF 61 or are relatively easily changed to be in compliance. However, shortly after NSF 61 was promulgated, it became clear through testing that the copper water storage tank and related heat exchanger components (i.e., incoming and wrapped/heat exchange water tubing) are the principal components requiring modification to meet the maximum copper emission level of NSF 61. The level emitted by conventional such components was typically 3–4 times the maximum allowable level.

NSF 61 limits copper emissions to a maximum contaminant level of 130 parts-per-billion (ppb), which is at 10% of the EPA-allowed level. NSF 61 is a durational test with numerous specific requirements; it also employs a normalization factor of one liter, so that if a storage tank has a capacity of one-half liter, a dilution factor of 100% is used, meaning that 260 ppb of copper emissions is allowed for a one-half liter storage tank, since one-half liter of pure water will then be added to the test sample. However, if the storage tank has a capacity of one liter or more, then copper emissions must be less than or equal to 130 ppb. 36 states have now adopted NSF 61, and enforcement of this standard is expected soon. No currently available water coolers employing storage tanks with wrapped copper water tubing meet this standard.

A second style of known water cooler storage tank design is a "tube-on-tube" design. This incorporates a large-diameter coiled water tube (e.g., 0.75" diameter) wound side-by-side with a refrigerant tube (e.g., 0.25"–0.35" diameter). Here, the large water tubing doubles as the "storage tank". Using currently available copper water tubing, however, NSF 61 cannot be met with this tube-on-tube design, either. Further, stainless steel is difficult to bend into the forms required for this design.

In circumventing the NSF 61 copper emissions problem, feedback from copper suppliers was not helpful. Specifically, no known copper suppliers provide NSF-61 compliant tubing. Further, queried suppliers were not aware of any treatments or selection processes that could be performed on copper tubing to reduce copper emission levels. Instead, the copper industry lobbied NSF in an attempt to change or remove the NSF 61 limit for copper.

Plating operations were also attempted to obtain NSF 61 compliance. Nickel plating of a copper storage tank, for example, was tested. However, while this was successful in limiting copper emissions in the tank, NSF 61 limits for nickel were exceeded. Further, plating does not address copper contact levels for water coils wrapped around the storage tank.

Accordingly, it is an object of the present invention to provide a water cooler capable of limiting copper emissions to less than 130 ppb so that NSF 61 may be complied with.

It is another object of the present invention to provide a process for treating and/or selecting copper tubing which provides substantially decreased copper emissions.

It is a further object to provide a process for the manufacture of copper and copper alloy components and fittings for use in contact with potable water which provides substantially decreased copper emissions.

It is yet another object to provide a non-copper water cooler storage tank.

It is still another object to provide a water cooler storage tank with decreased leakage and corrosion characteristics.

These and other objects and advantages of the present invention will become apparent to those of ordinary skill in the art from reading the following description of the preferred embodiments, drawing and appended claims.

SUMMARY OF THE INVENTION

The present invention satisfies these and other objects, while also preserving the advantages of known water coolers and water cooler storage tanks, and avoiding their disadvantages.

In one preferred embodiment, a water chilling and storage apparatus for use in a water cooler is provided. The water cooler may either be a pressure cooler or a bottle cooler. The apparatus includes a storage tank for holding a supply of water, and components in heat exchange relationship with the storage tank for cooling the water. The components include copper or copper alloy tubing carrying water for delivery to the storage tank. "Copper" as used in the claims is intended to cover both copper and copper alloy components. The copper or copper alloy tubing is annealed sufficiently to limit the presence of copper emissions in the water exiting the storage tank to a maximum concentration of 130 parts-per-billion, so that NSF 61 may be complied with. In one preferred annealing treatment, the copper or copper alloy tubing is heated following work hardening to a sufficient annealing temperature, such as about 600° F., and held at this temperature for a sufficient time period, such as about one hour.

Preferably, the heat exchange components of the apparatus, including the copper tubing, are of a sufficient size and internal surface area such that chilled water may be discharged from the storage tank at a rate of between 0 and 16 gallons-per-hour while meeting the ARI 1010 rating, or a comparable cooling capacity.

In a preferred embodiment, the storage tank includes a metallic shell. In a particularly preferred embodiment, the metallic shell is made of a non-copper material, such as stainless steel or another material. With this embodiment, copper may also be employed, preferably coating the internal surface area of the shell with a non-copper material. In the preferred embodiment, the shell is sealed in a water-tight relation by an end cap, such as a plastic, injection-molded cap.

In addition to or instead of the annealing/heat treatment described above, copper components such as copper water tubing are preferably selected to have a grain size sufficient to to limit the presence of copper emissions in the water exiting the storage tank to a maximum concentration of 130 parts-per-billion, and/or to meet NSF 61. In a preferred embodiment, the grain size is selected to be substantially above 40 microns, and preferably about equal to or in excess of 60 microns.

In one preferred embodiment, the ratio of the combined volumetric capacity of any copper-made items in contact with potable water and including the storage tank and components in heat exchange relationship with the storage tank, to the combined volumetric capacity of such items in contact with potable water and including the storage tank and components in heat exchange relationship with the storage tank, is less than about 30% and, more preferably, less than 15%.

In another embodiment, the ratio of the combined internal surface area of any copper-made items in contact with potable water and including the storage tank and components in heat exchange relationship with the storage tank, to the combined internal surface area of such items in contact with potable water and including the storage tank and components in heat exchange relationship with the storage tank, is less than about 70% and, more preferably, less than about 60%–70%.

A process for providing copper or copper alloys for use in fabricating one or more devices, fittings or water cooler components made of copper or copper alloy and in contact with drinking water also forms part of the present invention. In this process, the copper or copper alloy is work hardened to form the copper into a selected shape for use as (e.g.) a water cooler component. Thereafter, the copper is annealed by heating the copper to a temperature and for a time sufficient to limit the copper concentration within effluent from the water cooler to a maximum of 130 parts-per-billion, and/or to meet NSF 61.

In another preferred process embodiment, the copper is work hardened to form the copper into a selected shape for use as a water cooler component. Prior to the work hardening step, however, the copper is selected to have a grain size sufficient to limit the copper concentration within effluent from the water cooler to 130 ppb and/or so that NSF 61 may be complied with.

In a particularly preferred embodiment, a grain size selection step prior to work hardening may be provided in addition to an annealing step provided after work hardening.

In yet another embodiment of the present invention, a water chilling and storage apparatus is provided for use in a water cooler, and includes a storage tank for holding a supply of water, and components in heat exchange relationship with the storage tank for cooling the water. In a preferred embodiment, the storage tank has a non-copper metallic shell and a plastic cap, with the shell and cap being connected in a water-tight relationship. The heat exchange components may include copper tubing carrying water for delivery to the storage tank.

It will be recognized that the processes of the present invention are adaptable to the manufacture of other copper and copper alloy devices and fittings which may come into contact with potable water.

BRIEF DESCRIPTION OF THE DRAWING

The novel features which are characteristic of the invention are set forth in the appended claims. The invention itself, however, together with further objects and attendant advantages thereof, will be best understood by reference to the following description taken in connection with the accompanying drawing, in which:

FIG. 1 is a perspective view showing the individual components of a preferred embodiment of the water cooler storage tank of the present invention;

FIG. 2 is a perspective view showing the storage tank in the working environment of a pressure cooler such as a drinking fountain;

FIG. 8 is a side view of a preferred embodiment of the storage tank, with the insulation cladding shown in cross-section; and FIGS. 9 and 10 are perspective views of examples of prior art water cooler storage tanks.

DETAILED DESCRIPTION OF THE PREFERRED EMBODIMENTS

Figure 3:
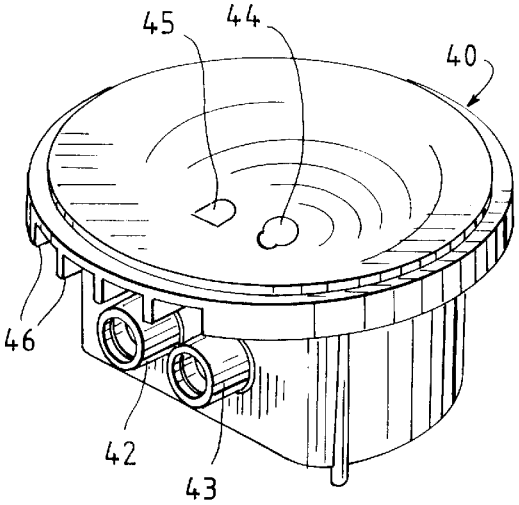
FIG. 3 is a top and side perspective view of an end cap of the preferred embodiment of the storage tank of the present invention.

Set forth below is a description of what are currently believed to be the preferred embodiments and/or best examples of the invention claimed. Future and present alternatives and modifications to this preferred embodiment are contemplated. Any alternatives or modifications which make insubstantial changes in function, in purpose, in structure or in result are intended to be covered by the claims of this patent.

Referring first to FIGS. 1 and 2, a preferred embodiment of the water cooler storage tank of the present invention is generally designated as 20. FIG. 2 is an example of storage tank 20 arranged in the working environment of a pressure cooler 10, where it may be positioned (e.g.) above the compressor (not shown). Alternatively, of course, storage tank 20 of the present invention may be used in conjunction with a bottle cooler.

Referring back to FIG. 1, storage tank 10 preferably consists of a metallic shell 30 and a plastic end cap or tank base 40. An inner coil of refrigerant copper tubing 50, and an outer coil of copper water tubing 60, are preferably wound around shell 30. Water from a potable water supply may enter coil 60 from a position at the lower portion of tank 20 and traverse the coils in an upward direction or, alternatively, water may enter coil 60 from a position at an upper portion of tank 20 and traverse the coils in a downward direction. As is well known, the copper tubing is preferably typically tin-coated, to improve heat transfer capabilities. Sealing ring 70, which may be made of an NSF-compatible, ammonia-resistant rubber compound such as EPDM (ethylene propylene DM) and preferably has a square cross-section, lays on annular shelf 41 of end cap 40, so that cap 40 and shell 30 are sealed in a water-tight relationship. A generally annular-shaped retaining ring 75, which may be made of stainless steel, fits under shelf 41. The lower portion of shell 30 may then be placed over shelf 41, and ring 75 may be spot-welded in place to the lower inside lip of shell 30, firmly connecting shell 30 and cap 40.

In the preferred embodiment, shell 30 provides a suitable enclosure for storing a chilled supply of potable water, while facilitating chilling due to the heat transfer qualities of the preferably metallic shell. In a preferred embodiment, and unlike past storage tanks consisting only of copper, shell 30 is made of stainless steel. Other embodiments are envisioned, in which the shell may be made from other insoluble and otherwise suitable materials. such as cold-rolled steel. In another embodiment shell 30 may consist of a base substrate of copper, for example, while having a coating of a non-copper (e.g., stainless steel) internal surface area in contact with the potable water supply. An advantage of using certain grades of stainless steel (such as #304 used by the assignee) is that there is no need to test for metal emissions.

In a preferred embodiment, end cap 40 seals the end of storage tank 20, provides water inlet and outlet fittings, and creates a mounting system for installation of the assembled, complete water cooler, as further described below. End cap 40 is preferably made of an injection-molded engineering plastic such as acetel plastic. One particularly preferred embodiment of cap 40 is a NSF-compatible Celcon-type plastic, M-90, available from Hoechst Celanese. This plastic provides several desirable qualities such as stability/insolubility in the presence of potable water, sufficient strength in light of pressurized water sources and (e.g.) water hammer effects, and non-corrosion and non-taste qualities. While for manufacturing and cost purposes it is desired to use a cap 40 having relatively thin side walls, ribs 46 may be used to provide additional strength so that (e.g.) cap 40 may be designed to withstand 2—3 (or more) times municipal water pressures which may be encountered. The entire cap 40 is preferably made of injection-molded plastic.

Alternatively, an all-metal storage tank may be used, made of (e.g.) stainless steel. Such an embodiment would still have potential brazing/corrosion, leakage and cost (stainless steel is generally more costly than copper or plastic) issues, however.

Figure 4:
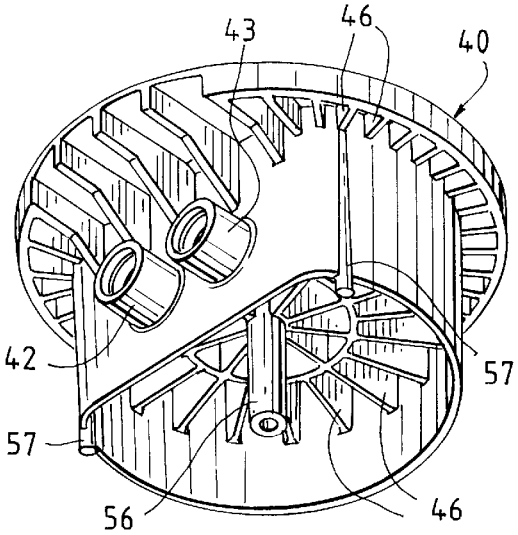
FIG. 4 is a bottom and side perspective view of the end cap.
Figure 5:
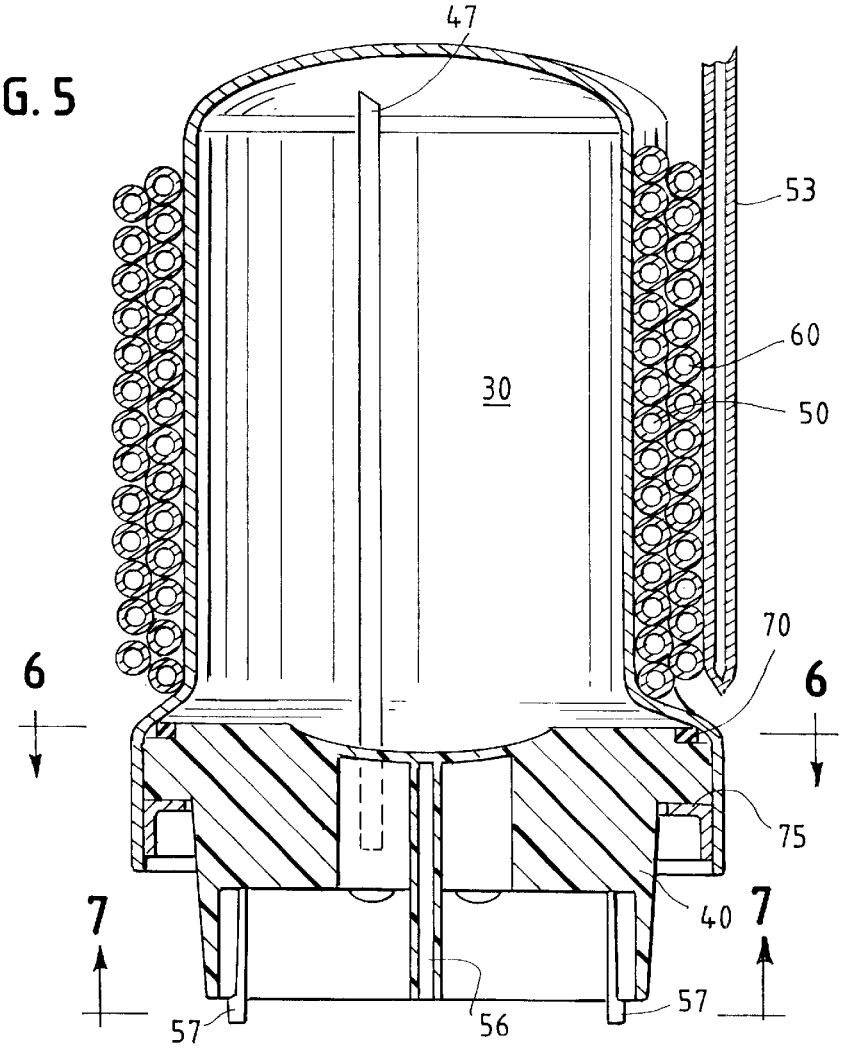
FIG. 5 is a side cross-sectional view, taken along section line 5—5 of FIG. 8, of the preferred embodiment of the assembled storage tank of the present invention, without the insulation cladding.

End cap 40 of the preferred embodiment incorporates molded water hook-up connections and internal water routing paths, as now described. Referring to FIGS. 3 and 4, cap 40 includes water inlet fitting 42 and water outlet fitting 43. Inlet fitting 42 receives water from water tubing 60. This water flows through inlet port 45 and into shell 30. Conversely, chilled water from shell 30 flows through drainage port or opening 44 into outlet fitting 43, where it may be supplied to a user of the water cooler.

The upper surface 42 of cap 40 is sloped or tapered so that water tends to flow toward drainage opening 44 located on the upper surface of cap 40. In this manner, cap 40 allows for water drainage without the need for incorporating an additional tube connection, eliminating further brazing.

Figure 6:
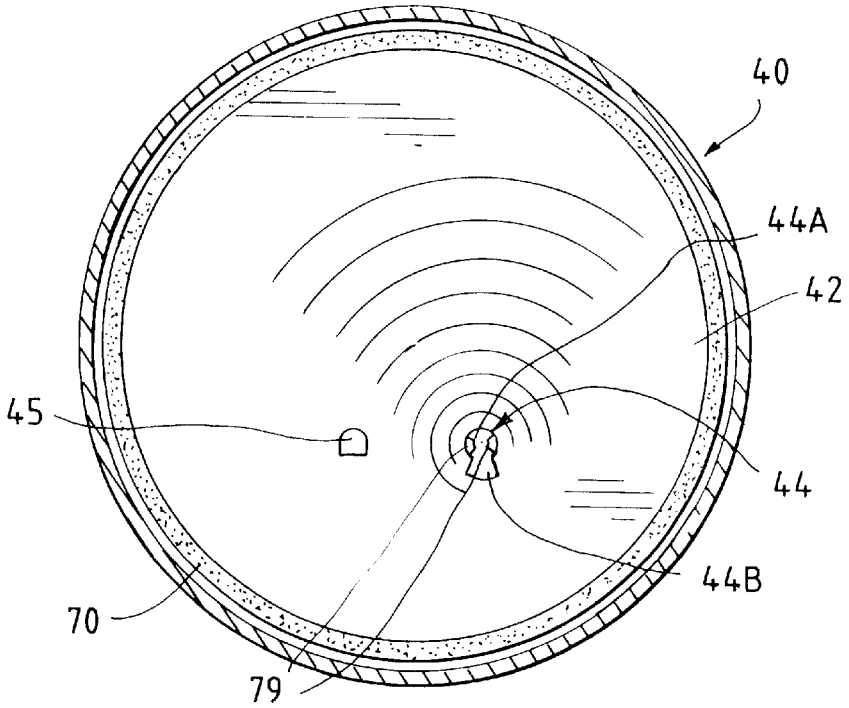
FIGS. 6 and 7 are top and bottom views taken along section lines 6—6 and 7—7 of FIG. 5, respectively, of the end cap.

Referring to FIGS. 1, 3, 5 and 6, air bleed tube 47 fits within drainage opening 44, with its downward entry being limited by ribs 49 contained a distance below the level of opening 44 (see FIG. 6). The upper portion of air bleed tube 47 reaches to the top of the inside surface of shell 30. Opening 44 is generally shaped in a "figure-8", with a circular portion 44A containing bleed tube 47, and an adjacent flattened opening 44B. Drainage opening 44 is preferably shaped to provide a venturi action during filling of the tank with water, i.e., as air is bled from the top of shell 30, air leaving the bottom of bleed tube 47 will tend to induce water flow through drainage opening 44A. In other words, air is driven to the upper portion of shell 30 as tank 20 fills; this air is then purged, via bleed tube 47, allowing the entire tank to be filled with water. Therefore, no separate drainage tube is necessary.

As is conventional, a temperature sensing bulb well 53 is employed (FIG. 1). A temperature sensing tube (not shown) from a thermostat may be located within bulb well 53, to sense the temperature of the water within coil 60. This enables the compressor to be turned off, controlling the water temperature and ensuring that the water does not freeze.

Figure 7:
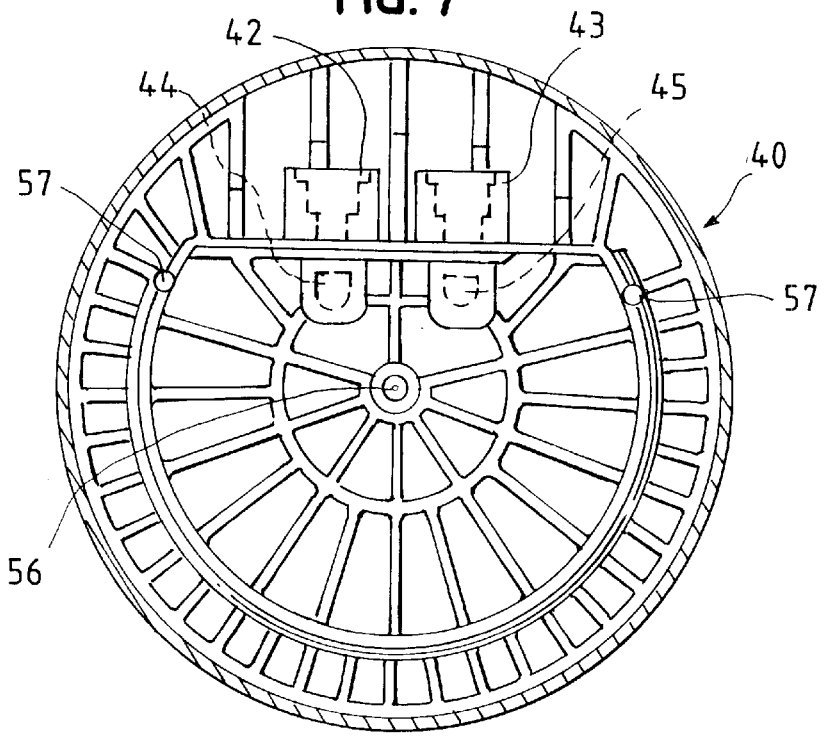

End cap 40 also provides a stable mounting surface for storage tank 20. Thus, end cap 40 is provided with a mounting pin 56, which may be threaded or not, and locating pins 57 (see FIGS. 4, 5 and 7) for facilitating the location of cap 40 on a suitable mounting surface within cooler 10.

Certain volume and surface area ratios may serve to further illustrate the present invention. With the prior art, and limiting the inquiry to the storage tank and associated wrapped water tubing, the ratio of the volumetric capacity of copper-coated components (Vc) to the total volumetric capacity of such components (Vt) is 1:1 or 100%, since all such components in contact with the potable water supply have typically been fabricated from copper. With the present invention, this ratio is about 11%–12%, for two storage tanks fabricated by Applicants according to the present invention, termed here "small" and "large" embodiments. For Applicants' "small" storage tank, Vc=119 milliliters (the volume of the copper tubing wrapped around the storage tank) while Vt=1071 ml. (The tank volume is 1071–119 =952 ml.) For Applicants' "large" storage tank, Vc=194 ml. and Vt=1610 ml. Since 1 gallon=3.79 liters, the storage capacity of Applicant's "small" and "large" tanks is 0.283 gallons and 0.425 gallons, respectively. Applicants envision that the Vc/Vt ratio may be increased to as much as about 30% or more while still permitting substantially decreased copper emissions such that NSF 61 may be met. Preferably, however, the Vc/Vt ratio is about 15% or less.

Similarly, analyzing the internal surface area of copper components (SAcu) to the total internal surface area of the tank and associated wrapped tubing (SAt) yields the following for Applicants' "small" embodiment: SAcu/SAt=113 $in^2$/196 $in^2$=0.58; for the "large" embodiment: SAcu/SAt= 185/296=0.62. For conventional storage tanks, the ratio is, again, 1:1. Applicants currently envision that the SAcu/SAt ratio may be increased to as much as about 70% or possibly more while still permitting substantially decreased copper emissions such that NSF 61 may be met. Preferably, however, the Vc/Vt ratio is about 60%–70% or less.

It may also be useful to analyze the ratio of the volume of wrapped copper water tubing associated with the storage tank (Vc) to the total internal surface area of the storage tank and associated wrapped water tubing (SAt), or Vc/SAt. This ratio is about 0.33 inches for each of Applicant's "small" and "large" storage tanks, while it is about 0.04 inches for a conventional, all-copper storage tank. Thus, for the "small" embodiment, SAt=196 $in^2$; for the "large" embodiment, SAt=297 $in^2$ (1 liter=61.02 $in^3$) Applicants note that, for the "small" tank, the internal surface area of the copper water tubing (SAcu) is 113 $in^2$, so that the internal surface area of the shell and cap (SAsc) is 83 $in^2$; for the "large" tank, SAcu=185 $in^2$ and SAsc=112 $in^2$.

Cooling capacity should also be examined. The American Refrigeration Institute (ARI) has promulgated a cooling capacity standard, ARI 1010. Currently, to meet ARI 1010, water coolers are typically rated at between 0 and 16 gallons/hour, assuming the water cooler is working within an environment that has an ambient temperature of 90° F., that the incoming water has a temperature of 80° F., and that the discharged, chilled water has a temperature of 50° F. In addition to NSF 61, ARI 1010 is a further parameter that water coolers should meet. In addition, for obvious reasons, the storage tank capacity should be sufficient (e.g., 0.25–0.5 gallons) such that the water cooler is capable of dispensing a number of consecutive cups of chilled water.

Applicants have found that the preferred embodiment of storage tank 20 described above provides a water cooler which substantially limits copper emissions as compared to water coolers employing conventional storage tanks. However, Applicants learned that this preferred storage tank design is not itself sufficient to provide a water cooler which meets the stringent copper emission restrictions of NSF 61, i.e., less than 130 ppb. Thus, Applicants have discovered that in addition to employed the preferred storage tank design described above, the copper tubing in contact with potable water within the water cooler must be properly selected and/or treated. More specifically, Applicants discovered that appropriate copper treating to further limit copper emissions to the low levels of NSF 61 involves either a specific heat treatment following work hardening, or proper copper grain size selection, or a combination of both steps, as now described.

Applicants discovered that the copper emissions level per unit area of a copper component increases as the cold working of the copper increases for that component. In response to this finding, Applicants queried various sources within the copper industry to determine if the use of a softer copper material than presently available might result in reduced copper emission levels. The universal response from the copper industry was that the hardness level of the copper would not affect the copper emission rate. However, actual testing by Applicants confirmed that the copper contaminant level can be reduced by selecting a "soft" copper. Accordingly, Applicants provided an annealing step, described below, to stress relieve and/or soften the copper tubing after work hardening. With this annealing step, Applicants were able to fabricate water coolers that meet the copper emissions limit of NSF 61.

Specifically, after all work hardening has been performed on the copper (e.g., the water tubing is untapped around the shell), the shell/tubing combination is annealed by heating it. In one preferred process, the work-hardened copper or copper alloy component(s) are placed on a chain link conveyor (e.g., 50–60 feet long) running through a flow-through oven. In one process, for annealing wrapped copper water tubing for the shell/tubing combination of the embodiment described above, the traverse time was 55 minutes, and the oven temperature was about 700° F. The copper components were intended to be heated to an internal, stabilized temperature of at least about 600° F. It is currently believed that heating the copper to above 800° F.–900° F. is detrimental to the process, since this is believed to increase the oxide build-up. An increased oxide layer may have several detrimental impacts, including cosmetic (the potable water appears murky or "dirty") and practical (it is harder to tin the copper, since the oxide layer also coats the outside surface of the copper, and it is more difficult to solder in the presence of the oxide layer). Further testing is necessary to determine the complete ranges of temperatures and holding times which will provide sufficient stress release and/or softening of the copper.

It is currently believed that this annealing operation may not enlarge grain size, but may rather soften microscopic peaks created by work hardening the formed copper tubing. It may be that work hardening creates, at the microscopic level, peaks and ridges at the grain boundaries, which increase the copper surface area in contact with water, similar to the dimples on a golf ball increasing its surface area as opposed to a smooth finish. The annealing operation may smooth out the peaks and effectively reduce the copper surface area in contact with the water.

Applicants discovered that NSF 61 may also be complied with using the shell/cap storage tank design described above, in the absence of this annealing treatment. This requires copper selection with a grain size (GS, measured in microns, or $1*10^{31\ 6}$ meters, so that a GS of 40 means an actual grain size of 0.040 millimeters) that is larger than the grain size of currently available copper. Grain size is a measure that describes the hardness/softness of copper. The larger the grain size, the softer the copper. Applicants successfully tested copper water tubing with a GS of 60. Copper tubing available for drinking water applications and in the plumbing business has a GS of 45 or less, which does not allow (in the absence of the annealing treatment described above) compliance with NSF 61. The assignee, for example, is a water cooler manufacturer which has typically used a refrigeration grade of copper (GS=45 or less) for both refrigeration and water lines. Copper tubing with a GS in excess of 45 has not been available to the drinking water industry generally, since copper suppliers have not been fabricating this copper type. It is currently believed that starting with a larger grain size (e.g., GS=60) may not create the same microscopic peaks following work hardening as would otherwise be formed with copper types having a lower grain size (e.g., GS=40).

While copper components which result from a combination of the annealing treatment and appropriate GS selection have not been tested for copper emissions, it is believed that such copper components would yield still lower copper contaminant levels.

To summarize, some of the advantages provided by the present invention include:

(1) the provision of a process for annealing and/or selecting, through appropriate grain size, copper or copper alloy components, devices and fittings in contact with potable water, providing substantially decreased copper emissions;

(2) a water cooler employing a storage tank/heat exchanger design that enables the water cooler to meet NSF 61 copper emission and ARI 1010 cooling capacity requirements;

(3) the provision of a storage tank that avoids the potential for leakage and corrosion as with conventional brazed-component storage tanks and/or those have weld seams;

(4) the use of a storage tank made of stainless steel and plastic, without the need for substantial bending of the stainless steel;

(5) a reduction in the number of solder joints/brazed connections, which are potential leak connections and also possible sources of corrosion; and (6) the provision of increased flexibility to water cooler manufacturers seeking to be NSF 61 compliant while still meeting ARI 1010 and providing a storage tank with sufficient capacity.

The foregoing description of the preferred embodiments of the present invention has been presented for purposes of illustration and description. The described embodiments are not intended to be exhaustive or to limit the invention to the precise form disclosed. Obviously many modifications and variations are possible in light of the above teachings. For example, the invention has application to both copper components as well as copper alloy components, such as tubing made of copper and zinc (bronze). The invention may of course be used with both pressure and bottle water coolers. In addition, the invention also has applications for devices and components other than water coolers. Thus, the annealing and/or grain size selection processes of the invention may be used in connection with other devices (e.g., pumps), feed tubes for faucets, fittings, and tubing used in other applications (e.g., refrigerant tubing for ice-makers, water fillers, etc.).

The embodiments which are described were chosen in order to best explain the principles of the invention and its practical applications, as they are presently understood by the inventor. It is therefore intended that the scope of the invention, as defined by the following claims, be interpreted to include all equivalent devices, components, processes and systems falling within the spirit of the present invention.

All words used in the claims are intended to be used in the normal, customary usage of grammar and the English language.

The above description is not intended to limit the meaning of the words used in the following claims that define the invention. Rather, it is contemplated that future modifications in structure, function or result will exist that are not substantial changes and that all such insubstantial changes in what is claimed are intended to be covered by the claims.

We claim:

1. A process for fabricating copper-containing components in contact with potable water, comprising the steps of:

selecting a copper material to have a grain size sufficient to limit the copper concentration within the water; and forming the component into a selected shape, so that after the water has left contact with the component, NSF 61 may be-complied with.

2. The process of claim 1, wherein the grain size is selected to be greater than about 60 microns.

3. A process for fabricating copper-containing components in contact with potable water, comprising the steps of:

work hardening the component to form the component into a selected shape; and after work hardening, heating the component to anneal the copper sufficiently so as to limit the presence of copper emissions in the water so that the water, after it has left contact with the component, may comply with NSF 61.

4. The process of claim 3 wherein, prior to the work hardening step, the copper is selected to have a grain size sufficient to limit the copper concentration within the water so that the water, after it has left contact with the contact, may comply with NSF 61.

5. A process for fabricating one or more water cooler components in contact with drinking water dispensed by the water cooler, comprising the steps of:

work hardening copper to form the copper into a selected shape for use with a water cooler component; and thereafter annealing the copper by heating the copper to a temperature and for a time sufficient to limit the copper concentration within effluent from the water cooler to a maximum of 130 parts-per-billion when tested to meet NSF 61 requirements.

6. A process for fabricating one or more water cooler components in contact with drinking water dispensed by the water cooler, comprising the steps of:

work hardening copper to form the copper into a selected shape for use as a water cooler component; and prior to the work hardening step, selecting the copper to have a grain size sufficient to limit the copper concentration within effluent from the water cooler so that NSF 61 may be complied with.

7. A process for fabricating one or more water cooler components in contact with drinking water dispensed by the water cooler, comprising the step of selecting copper to be used in making the components the copper to be disposed in liquid communication with the drinking water to be dispensed, the copper having a grain size substantially greater than 40 microns and sufficient to limit the copper concentration within effluent from the water cooler so that NSF 61 may be complied with.

8. A water chilling and storage apparatus for use in a water cooler, comprising:

a storage tank for holding a supply of water, the storage tank comprising a non-copper metallic shell and a plastic cap, wherein the shell and the cap are connected in a water-tight relationship; and components in heat exchange relationship with the storage tank for cooling the water, the components including copper tubing carrying water for delivery to the storage tank.

* * * * *